US006893216B2

(12) United States Patent
Snook et al.

(10) Patent No.: US 6,893,216 B2
(45) Date of Patent: May 17, 2005

(54) TURBINE BUCKET TIP SHROUD EDGE PROFILE

(75) Inventors: Daniel David Snook, Moore, SC (US); Peter Gaines Cleveland, Greenville, SC (US)

(73) Assignee: General Electric Company, Schenectady, NY (US)

( * ) Notice: Subject to any disclaimer, the term of this patent is extended or adjusted under 35 U.S.C. 154(b) by 58 days.

(21) Appl. No.: 10/620,365

(22) Filed: Jul. 17, 2003

(65) Prior Publication Data

US 2005/0013692 A1 Jan. 20, 2005

(51) Int. Cl.[7] ..... F01B 11/08
(52) U.S. Cl. ..... 415/173.1; 416/189
(58) Field of Search ..... 415/173.1; 416/189

(56) References Cited

U.S. PATENT DOCUMENTS 5,083,903 A * 1/1992 Erdmann ..... 416/190
5,290,144 A * 3/1994 Kreitmeier ..... 415/173.1
6,241,471 B1 * 6/2001 Herron ..... 415/173.1
6,254,345 B1 * 7/2001 Harris et al. ..... 416/189
6,499,950 B2 * 12/2002 Willett et al. ..... 416/189
6,579,066 B1 * 6/2003 Saito et al. ..... 416/243
6,736,596 B2 * 5/2004 Ito et al. ..... 415/173.1
6,805,530 B1 * 10/2004 Urban ..... 415/173.4

* cited by examiner

*Primary Examiner*—Edward K. Look
*Assistant Examiner*—Igor Kershetyn
(74) *Attorney, Agent, or Firm*—Nixon & Vanderhye

(57) ABSTRACT

A turbine bucket includes a bucket airfoil having a tip shroud with leading and trailing edges defining leading and trailing edge profiles substantially in accordance with Cartesian coordinate values of X and Y at points 12–20 and 1–11, respectively, set forth in Table I. The X and Y values are distances in inches which, when respective points 12–20 and 1–11 are connected by smooth, continuing arcs, define the leading and trailing edge tip shroud profiles. An airfoil profile at 95% span is defined by Cartesian coordinate values of X, Y and Z in Table II having the same X, Y origin along the radial Z axis as the origin of Table I. The profiled leading and trailing edges of the tip shroud relative to the airfoil profile afford optimum tip shroud mass distribution which maximizes creep life of the bucket. Stage efficiency is also improved by providing a tip shroud covering the airfoil throat.

16 Claims, 3 Drawing Sheets

TURBINE BUCKET TIP SHROUD EDGE PROFILE

BACKGROUND OF THE INVENTION

The present invention relates to turbine buckets having an airfoil and a tip shroud carried by the airfoil and particularly relates to leading and trailing edge profiles of a tip shroud carried by an airfoil of a turbine bucket.

Buckets for turbines typically comprise an airfoil, a platform, a shank and dovetail. The dovetail is secured in a complementary slot in a turbine wheel. Oftentimes, the airfoil includes an integrally formed tip shroud. The bucket including the airfoil and tip shroud are, of course, rotatable about the engine centerline during operation and the airfoil and the tip shroud are located in the hot gas path. Because the tip shroud is mounted at the tip of the airfoil, substantial stresses occur in the tip shroud fillet region between the tip shroud and the airfoil tip. Particularly, a significant difference in fillet stresses occurs between pressure and suction sides of the airfoil at its intersection with the tip shroud because of tip shroud mass imbalance relative to the airfoil. This mass imbalance negatively impacts the creep life of the bucket. That is, the tip shroud mass distribution in prior buckets resulted in a highly loaded tip shroud fillet and reduced creep life. Further, certain prior tip shrouds do not cover the airfoil throat, with resultant negative impact on stage efficiency due to flow leakage over the tip shroud.

BRIEF DESCRIPTION OF THE INVENTION

In accordance with a preferred embodiment of the present invention, there is provided a bucket tip shroud having leading and trailing edge profiles for optimizing tip shroud mass distribution to balance tip shroud fillet stresses, thereby maximizing creep life and also ensuring coverage of the airfoil throat to improve stage efficiency. Particularly, the leading edge of the tip shroud, i.e., the edge generally facing axially upstream in the hot gas path of the turbine, has a predetermined profile substantially in accordance with X and Y coordinate values in a Cartesian coordinate system at points 12–20 set forth in Table I, which follows, where X and Y are distances in inches from an origin. When points 12–20 are connected by smooth, continuing arcs, the points define the leading edge tip shroud profile. Similarly, the tip shroud trailing edge has a predetermined profile substantially in accordance with X and Y values of the coordinate system at points 1–11 set forth in Table I, wherein X and Y are distances in inches from the origin. When points 1–11 are connected by smooth, continuing arcs, these points define the trailing edge tip shroud profile.

Further, the leading and trailing edge profiles are matched to the airfoil profile at 95% span to maximize tip shroud creep life and improve stage efficiency. Particularly, the bucket airfoil has an airfoil profile at 95% span, i.e., just radially inwardly of the fillet region at the intersection of the tip shroud and the tip of the airfoil. This airfoil profile section at 95% span is defined, in accordance with X, Y coordinate values set forth in Table II, which follows, wherein the X and Y coordinate values of Table II are in inches and have the same origin as the X, Y coordinate values of Table I. Hence, the mass distribution of the tip shroud defined by the leading and trailing edge profiles is located relative to the airfoil section tip at 95% span.

It will also be appreciated that as the airfoil section and tip shroud heats up in use, the leading and trailing edge profiles of the tip shrouds will change as a result of stress and temperature. Thus, the cold or room temperature profile for the tip shroud is given by the X and Y coordinates for manufacturing purposes. Because a manufactured tip shroud may be different from the nominal tip shroud profile given by Table I, a distance of ±0.080 inches from the nominal profile at each of the leading and trailing edges in a direction normal to any surface location along the nominal profile and which includes any coating, defines a leading and trailing edge profile envelope for the tip shroud. The tip shroud is robust to this variation without impairment of mechanical and aerodynamic functions.

It will also be appreciated that the tip shroud and its attached airfoil section can be scaled up or scaled down geometrically for introduction into similar turbine designs. Consequently, the X and Y coordinates in inches of the nominal tip shroud profile for the leading and trailing edge given below in Table I may be a function of the same number. That is, the X, Y coordinate values in inches may be multiplied or divided by the same number to provide a scaled-up or scaled-down version of the tip shroud profile while retaining the profile shape. The airfoil likewise can be scaled up or down by multiplying the X, Y and Z coordinate values of Table II by a constant number.

In a preferred embodiment according to the present invention, there is provided a turbine bucket including a bucket airfoil having a tip shroud, the tip shroud having leading and trailing edges, the leading edge having a profile substantially in accordance with values of X and Y in a Cartesian coordinate system at points 12–20 set forth in Table I wherein X and Y are distances in inches which, when connected by smooth, continuing arcs, define the leading edge tip shroud profile.

In a further preferred embodiment according to the present invention, there is provided a turbine bucket including a bucket airfoil having a tip shroud, the tip shroud having leading and trailing edges, the trailing edge profile being defined substantially in accordance with values of X and Y in a Cartesian coordinate system at points 1–11 set forth in Table I wherein the X and Y values are distances in inches which, when the points are connected by smooth, continuing arcs, define the trailing edge profile of the tip shroud.

In a further preferred embodiment according to the present invention, there is provided a turbine bucket including a bucket airfoil having a tip shroud, the tip shroud having leading and trailing edges defining respective leading and trailing edge profiles substantially in accordance with values of X and Y in a Cartesian coordinate system at points 12–20 and 1–11, respectively, set forth in Table I, wherein the X and Y values are distances in inches which, when respective points 12–20 and 1–11 are connected by smooth, continuing arcs, define respective leading and trailing edge profiles of the tip shroud.

DETAILED DESCRIPTION OF THE INVENTION

Figure 1:
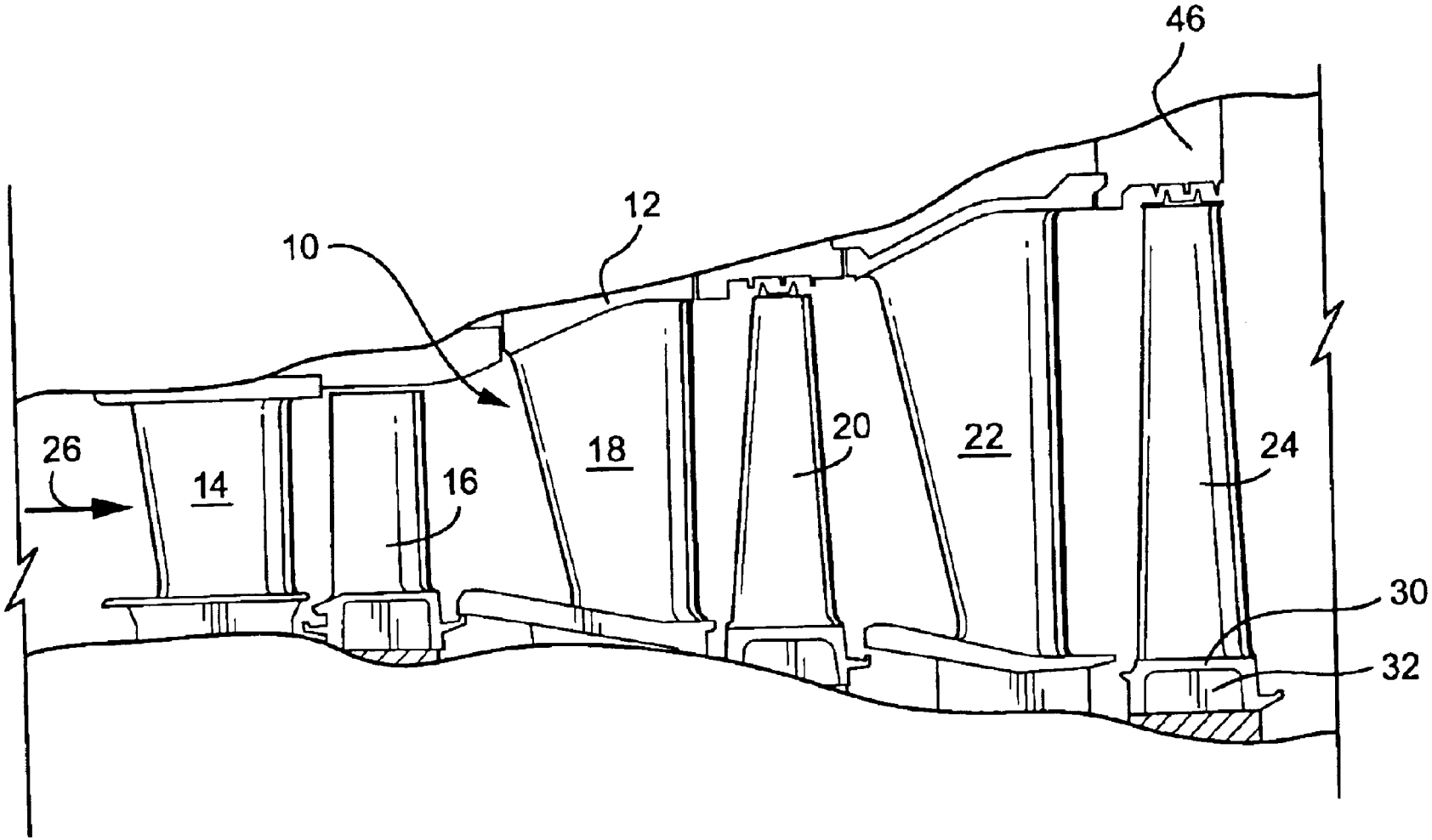
FIG. 1 is a schematic illustration of a turbine section having a third stage turbine bucket tip shroud with predetermined leading and trailing edge profiles according to a preferred embodiment of the present invention.

Referring now to the drawing figures, particularly to FIG. 1, there is illustrated a hot gas path, generally designated 10, of a gas turbine 12 including a plurality of turbine stages. Three stages are illustrated. For example, the first stage comprises a plurality of circumferentially spaced nozzles 14 and buckets 16. The nozzles are circumferentially spaced one from the other and fixed about the axis of the rotor. The first stage buckets 16, of course, are mounted on the turbine rotor wheel, not shown. A second stage of the turbine 12 is also illustrated, including a plurality of circumferentially spaced nozzles 18 and a plurality of circumferentially spaced buckets 20 mounted on the rotor. The third stage is also illustrated including a plurality of circumferentially spaced nozzles 22 and buckets 24 mounted on the rotor. It will be appreciated that the nozzles and buckets lie in the hot gas path 10 of the turbine 12, the direction of flow of the hot gas through the hot gas path 10 being indicated by the arrow 26.

Each bucket 24 of the third stage is provided with a platform 30, a shank 32 and a dovetail, not shown, for connection with a complementary-shaped mating dovetail, also not shown, on a rotor wheel forming part of the rotor. Each of the third stage buckets 24 also includes an airfoil 36 (FIG. 2) having an airfoil profile at any cross-section along the airfoil from the platform to the airfoil tip, as illustrated by the dashed lines in FIG. 2.

Figure 2:
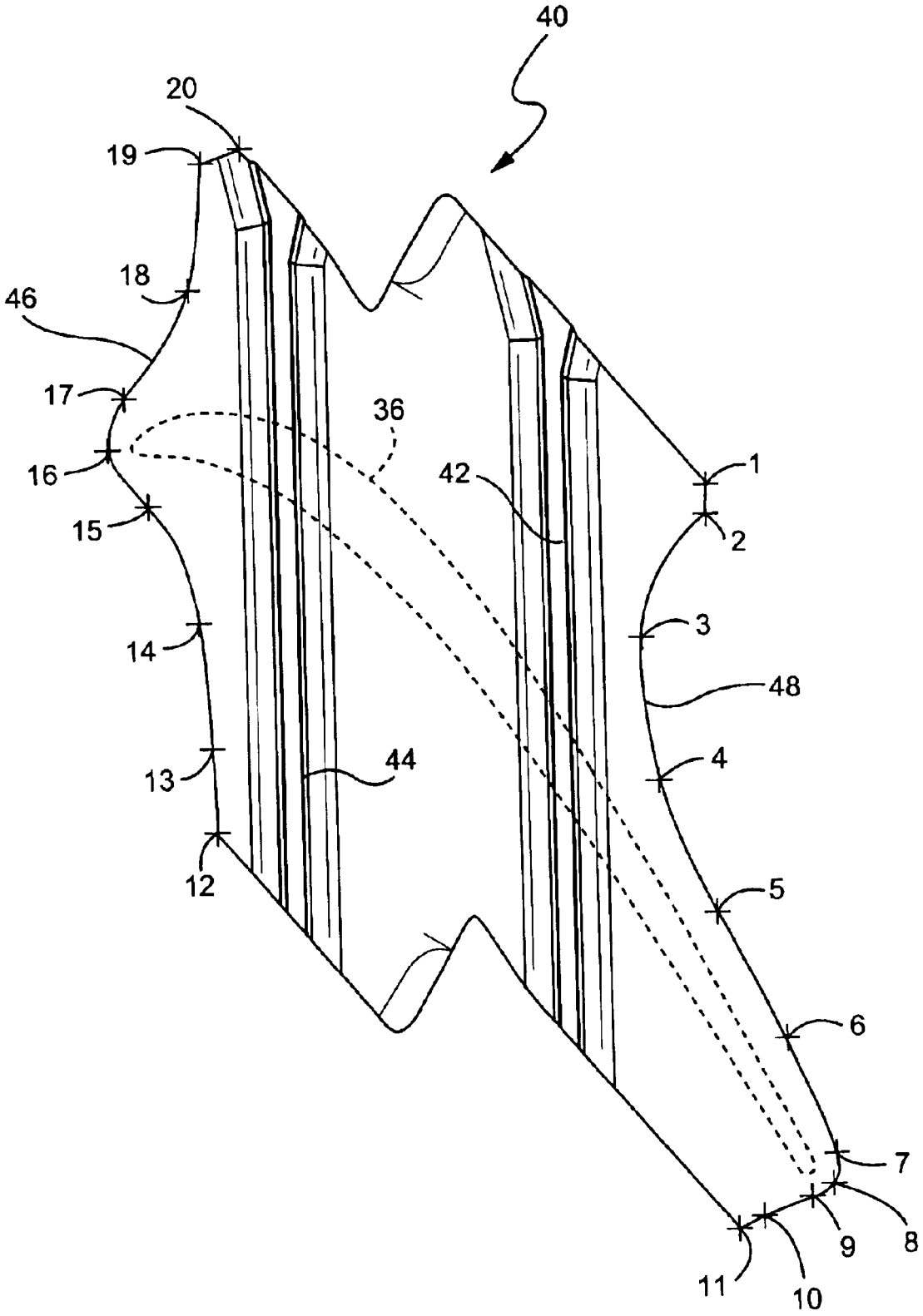
FIG. 2 is an enlarged end view of the shroud as viewed looking radially inwardly and illustrating the location of the points set forth in Table I.
Figure 3:
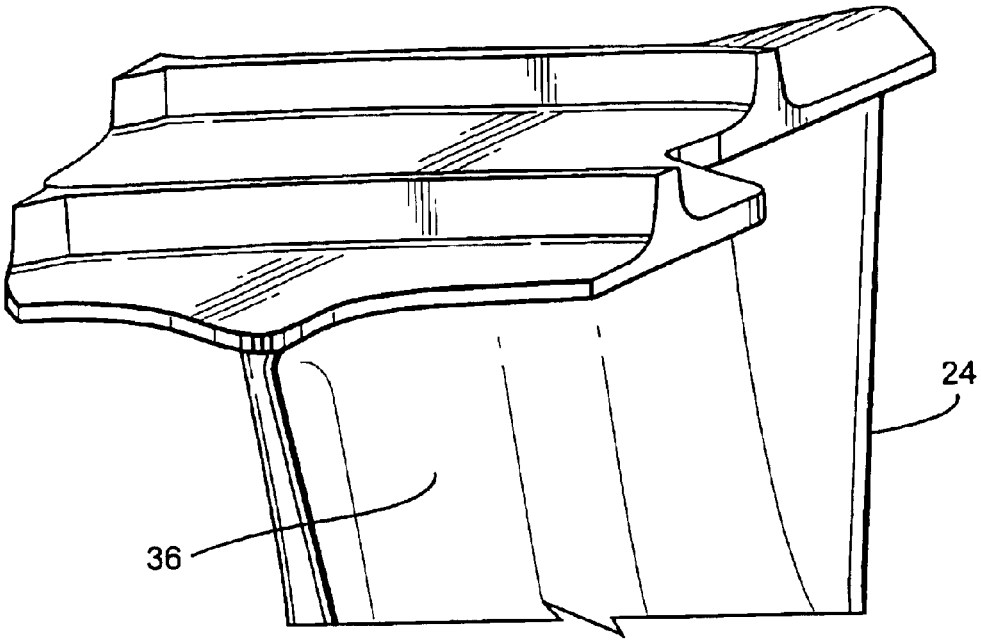
FIGS. 3 and 4 are enlarged perspective views taken from opposite sides of the tip shroud on the end of an airfoil section of a bucket.
Figure 4:
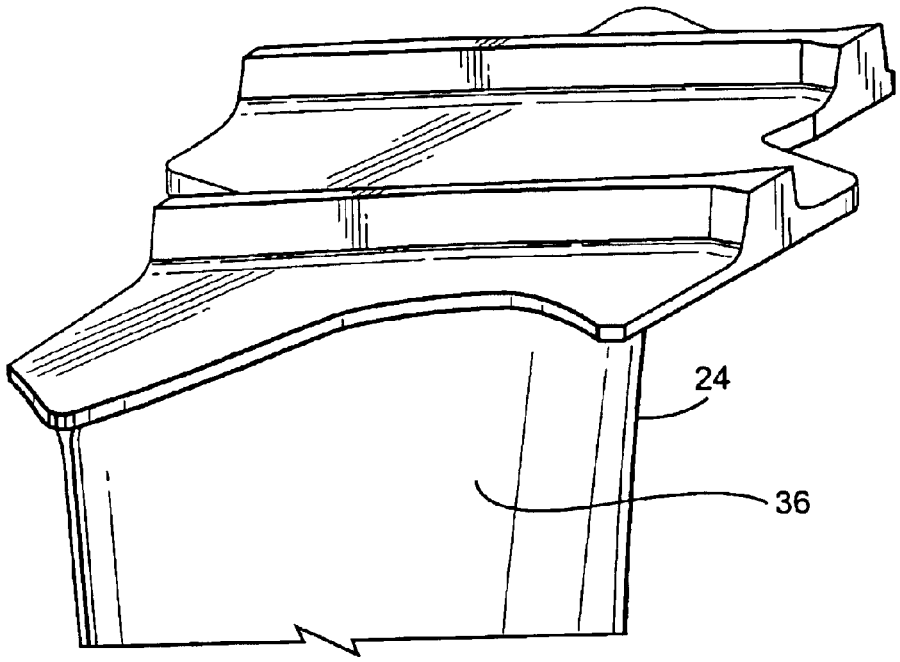

Each of the third stage buckets 24 is also provided with a tip shroud, generally designated 40 (FIG. 2). The tip shrouds 40 are preferably formed integrally with the buckets and each tip shroud engages at opposite ends adjacent tip shrouds of adjacent buckets to form a generally annular ring or shroud circumscribing the hot gas path at the location of the third stage buckets. As illustrated in FIG. 2, the tip shroud 40 of the third stage bucket 24 includes a pair of axially spaced seals 42 and 44 along its radial outer surface and which seals 42 and 44 form a pair of axially spaced, continuous seal rings about the tip shroud for sealing with the shroud 46 (FIG. 1) fixed to the turbine casing. As illustrated in FIG. 2, it will be appreciated that the tip shroud 40 includes shaped leading and trailing edges 46 and 48, respectively. That is, the edges 46 and 48 lie on opposite axial facing sides of the tip shroud 40 in the hot gas path. Also illustrated in FIG. 2 are a number of points, numbered 1 through 20. Note that the points 12–20 lie along the leading edge 46 and points 1–11 lie along the trailing edge 48 of the tip shroud 40, relative to the direction of the flow of hot gases along the hot gas path 10.

To define the shape of the leading and trailing edges 46 and 48, respectively, i.e., the profiles formed by those edges, a unique set or loci of points in space are provided. Particularly, in a Cartesian coordinate system of X, Y and Z axes, X and Y values are given in Table I below and define the profile of the leading and trailing edges at various locations therealong. The Z axis coincides with a radius from the engine centerline, i.e., the axis of rotation of the turbine rotor. The values for the X and Y coordinates are set forth in inches in Table I, although other units of dimensions may be used when the values are appropriately converted. By defining X and Y coordinate values at selected locations relative to the origin of the X, Y axes, the locations of the points numbered 1 through 20 can be ascertained. By connecting the X and Y values with smooth, continuing arcs along each of the leading and trailing edges 46 and 48, respectively, each edge profile can be ascertained.

It will be appreciated that these values represent the leading and trailing edge profiles at ambient, non-operating or non-hot conditions, i.e., cold conditions. More specifically, the tip shroud has a leading edge 46 defining a leading edge profile substantially in accordance with the Cartesian coordinate values of X and Y at points 12–20 set forth in Table I, wherein the X and Y values are distances in inches from the origin. When points 12–20 are connected by smooth, continuing arcs, points 12–20 define the leading edge tip shroud profile. Similarly, the tip shroud has a trailing edge 48 defining a trailing edge profile substantially in accordance with Cartesian coordinate values of X and Y at points 1–11 set forth in Table I, wherein X and Y are distances in inches from the same origin. When points 1–11 are connected by smooth, continuing arcs, points 1–11 define the trailing edge tip shroud profile. By defining the leading and trailing edge profiles in an X, Y coordinate system having a single origin, the shape of the tip shroud along the leading and trailing edges is defined.

Table I is as follows:

TABLE I

Tip Shroud Scallop Points

| Point No. | X | Y |
|---|---|---|
| 1 | 1.255 | 0.953 |
| 2 | 1.255 | 0.823 |
| 3 | 0.971 | 0.321 |
| 4 | 1.029 | −0.270 |
| 5 | 1.255 | −0.821 |
| 6 | 1.535 | −1.347 |
| 7 | 1.726 | −1.831 |
| 8 | 1.707 | −1.961 |
| 9 | 1.616 | −2.018 |
| 10 | 1.425 | −2.089 |
| 11 | 1.317 | −2.145 |
| 12 | −0.806 | −0.454 |
| 13 | −0.815 | −0.117 |
| 14 | −0.859 | 0.411 |
| 15 | −1.053 | 0.893 |
| 16 | −1.218 | 1.133 |
| 17 | −1.143 | 1.349 |
| 18 | −0.867 | 1.796 |
| 19 | −0.806 | 2.320 |
| 20 | −0.646 | 2.378 |

*This point set is valid through the thickness of the tip shroud.

To correlate the mass distribution of the tip shroud with the fillets between the tip shroud and the airfoil and minimize stresses and maximize creep life, the tip shroud leading and trailing edge profiles are defined in relation to the profile of airfoil 36 at 95% span, i.e., just radially inwardly of the fillet region at the intersection of the tip shroud and the tip of the airfoil 36 of bucket 24. (The airfoil at 100% span would be imaginary and lie within the fillet region). The airfoil profile is similarly defined by coordinate values of X and Y in the same X, Y and Z Cartesian coordinate system defining the tip shroud edges. The origin of the X, Y coordinate system for the airfoil (Table II) and the origin of the X, Y coordinate system for determining the leading and trailing edge profiles of the shroud (Table I) are spaced from one another a distance of 5% span along a radial Z axis. Table II which defines the X, Y and Z coordinate values for the airfoil 36 at 95% span is given below. Thus, by defining X, Y and Z coordinate values, the profile of the airfoil section at 95% span as illustrated in FIG. 2 can be ascertained. By connecting the X and Y values with smooth, continuing arcs, the profile of the airfoil at 95% span is fixed in space in relation to the tip shroud. By using a common Z-axis origin for the X, Y coordinate systems for the tip shroud points and the points defining the airfoil profile at 95% span, the leading and trailing edge profiles of the tip shroud are defined in relation to the location of the airfoil at 95% span. It will be appreciated that the X, Y values for both the tip shroud points and the airfoil points are at ambient, non-operating or non-hot conditions (cold conditions). The Z value given in Table II is in actual inches for the preferred turbine and gives the distance between the airfoil section at 95% span and the engine centerline, i.e., the axis of rotation. The Z axis from the centerline passes through the origins of the X, Y coordinate systems for the airfoil and the tip shroud.

TABLE II

| X (95%) | Y (95%) | Z (95%) |
|---|---|---|
| −1.1558 | 0.9794 | 44.153 |
| −1.0663 | 0.962 | 44.153 |
| −0.9704 | 0.9667 | 44.153 |
| −0.8746 | 0.9629 | 44.153 |
| −0.7797 | 0.9491 | 44.153 |
| −0.6865 | 0.926 | 44.153 |
| −0.596 | 0.8944 | 44.153 |
| −0.5085 | 0.855 | 44.153 |
| −0.4242 | 0.8091 | 44.153 |
| −0.3432 | 0.7577 | 44.153 |
| −0.2653 | 0.7017 | 44.153 |
| −0.1901 | 0.642 | 44.153 |
| −0.1174 | 0.5794 | 44.153 |
| −0.047 | 0.5142 | 44.153 |
| 0.0213 | 0.4468 | 44.153 |
| 0.0877 | 0.3775 | 44.153 |
| 0.1524 | 0.3066 | 44.153 |
| 0.2154 | 0.2343 | 44.153 |
| 0.2772 | 0.1608 | 44.153 |
| 0.3377 | 0.0863 | 44.153 |
| 0.397 | 0.0108 | 44.153 |
| 0.4553 | −0.0654 | 44.153 |
| 0.5126 | −0.1424 | 44.153 |
| 0.569 | −0.22 | 44.153 |
| 0.6247 | −0.2982 | 44.153 |
| 0.6796 | −0.3769 | 44.153 |
| 0.7338 | −0.4561 | 44.153 |
| 0.7873 | −0.5358 | 44.153 |
| 0.8402 | −0.6158 | 44.153 |
| 0.8926 | −0.6963 | 44.153 |
| 0.9443 | −0.7771 | 44.153 |
| 0.9956 | −0.8582 | 44.153 |
| 1.0464 | −0.9396 | 44.153 |
| 1.0968 | −1.0213 | 44.153 |
| 1.1468 | −1.1032 | 44.153 |
| 1.1964 | −1.1854 | 44.153 |
| 1.2457 | −1.2677 | 44.153 |
| 1.2947 | −1.3503 | 44.153 |
| 1.3434 | −1.4329 | 44.153 |
| 1.3919 | −1.5158 | 44.153 |
| 1.4402 | −1.5987 | 44.153 |
| 1.4883 | −1.6817 | 44.153 |
| 1.5361 | −1.765 | 44.153 |
| 1.5834 | −1.8485 | 44.153 |
| 1.6582 | −1.8464 | 44.153 |
| 1.6264 | −1.7588 | 44.153 |
| 1.5815 | −1.674 | 44.153 |
| 1.5365 | −1.5893 | 44.153 |
| 1.4914 | −1.5046 | 44.153 |
| 1.4462 | −1.4199 | 44.153 |
| 1.4009 | −1.3353 | 44.153 |
| 1.3556 | −1.2507 | 44.153 |
| 1.3101 | −1.1662 | 44.153 |
| 1.2645 | −1.0817 | 44.153 |
| 1.2187 | −0.9974 | 44.153 |
| 1.1728 | −0.9131 | 44.153 |
| 1.1267 | −0.8289 | 44.153 |
| 1.0805 | −0.7448 | 44.153 |
| 1.034 | −0.6608 | 44.153 |
| 0.9874 | −0.577 | 44.153 |
| 0.9404 | −0.4933 | 44.153 |
| 0.8931 | −0.4098 | 44.153 |
| 0.8454 | −0.3265 | 44.153 |
| 0.7972 | −0.2435 | 44.153 |
| 0.7484 | −0.1609 | 44.153 |
| 0.699 | −0.0786 | 44.153 |
| 0.649 | 0.0033 | 44.153 |
| 0.5983 | 0.0848 | 44.153 |
| 0.5467 | 0.1657 | 44.153 |

TABLE II-continued

| X (95%) | Y (95%) | Z (95%) |
|---|---|---|
| 0.4943 | 0.2462 | 44.153 |
| 0.4409 | 0.3259 | 44.153 |
| 0.3862 | 0.4047 | 44.153 |
| 0.33 | 0.4825 | 44.153 |
| 0.2719 | 0.5589 | 44.153 |
| 0.2119 | 0.6338 | 44.153 |
| 0.1497 | 0.7069 | 44.153 |
| 0.0848 | 0.7776 | 44.153 |
| 0.0168 | 0.8453 | 44.153 |
| −0.0548 | 0.9092 | 44.153 |
| −0.1302 | 0.9685 | 44.153 |
| −0.2096 | 1.0224 | 44.153 |
| −0.2929 | 1.07 | 44.153 |
| −0.3799 | 1.1105 | 44.153 |
| −0.4701 | 1.143 | 44.153 |
| −0.5631 | 1.1668 | 44.153 |
| −0.658 | 1.1808 | 44.153 |
| −0.7538 | 1.1837 | 44.153 |
| −0.8493 | 1.1743 | 44.153 |
| −0.9422 | 1.1508 | 44.153 |
| −1.0297 | 1.1117 | 44.153 |
| −1.1083 | 1.0569 | 44.153 |

It will be appreciated that there are typical manufacturing tolerances, as well as coatings which must be accounted for in the actual profiles of both the tip shroud and the airfoil. Accordingly, the values for the tip shroud profile given in Table I are for a nominal tip shroud. It will therefore be appreciated that ± typical manufacturing tolerances, i.e., ±values, including any coating thicknesses, are additive to the X, Y values given in Table I above. Accordingly, a distance of ±0.080 inches in a direction normal to any surface location along the leading and trailing edges defines a tip shroud edge profile envelope along the respective leading and trailing edges for this particular tip shroud design, i.e., a range of variation between measured points on the actual edge profiles at nominal cold or room temperature and the ideal position of those edge profiles as given in the Table I above at the same temperature. The tip shroud design is robust to this range of variations without impairment of mechanical and aerodynamic function and is embraced by the profiles substantially in accordance with the Cartesian coordinate values of the points 12–20 and 1–11 set forth in Table I.

It will also be appreciated that the tip shroud disclosed in Table I above may be scaled up or down geometrically for use in other similar turbine designs. Consequently, the coordinate values set forth in Table I may be scaled upwardly or downwardly such that the tip shroud leading and trailing edge profiles remain unchanged. A scaled version of the coordinates of Table I would be represented by X and Y coordinate values of Table I multiplied or divided by the same number. Similarly, the X, Y and Z values for the airfoil at 95% span given in Table II may be scaled up or down, by multiplying those X, Y and Z values by a constant number.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A turbine bucket including a bucket airfoil having a tip shroud, said tip shroud having leading and trailing edges, said leading edge having a profile substantially in accordance with values of X and Y in a Cartesian coordinate system at points 12–20 set forth in Table I wherein X and Y are distances in inches which, when connected by smooth, continuing arcs, define the leading edge tip shroud profile.

2. A turbine bucket according to claim 1 wherein the bucket airfoil has a profile at 95% span in accordance with X, Y and Z coordinate values set forth in Table II wherein the Table II X, Y and Z coordinate values are in inches and have the same origin along a Z axis of the Cartesian coordinate system as the origin of the Table I X, Y coordinate values.

3. A turbine bucket according to claim 1 wherein the leading edge profile is consistent throughout the thickness of the tip shroud.

4. A turbine bucket according to claim 1 wherein the leading edge profile lies in an envelope within ±0.080 inches in a direction normal to any location along the leading edge profile.

5. A turbine bucket according to claim 1 wherein the X and Y values set forth in Table I are scalable as a function of the same number to provide a scaled-up or scaled-down leading edge profile.

6. A turbine bucket including a bucket airfoil having a tip shroud, said tip shroud having leading and trailing edges, said trailing edge profile being defined substantially in accordance with values of X and Y in a Cartesian coordinate system at points 1–11 set forth in Table I wherein the X and Y values are distances in inches which, when the points are connected by smooth, continuing arcs, define the trailing edge profile of the tip shroud.

7. A turbine bucket according to claim 6 wherein the bucket airfoil has a profile at 95% span in accordance with X, Y and Z coordinate values set forth in Table II wherein the Table II X, Y and Z coordinate values are in inches and have the same X, Y origin along a Z axis of the Cartesian coordinate system as the origin of the Table I X, Y coordinate values.

8. A turbine bucket according to claim 6 wherein the trailing edge profile is consistent through the thickness of the tip shroud.

9. A turbine bucket according to claim 6 wherein the trailing edge profile lies in an envelope within ±0.080 inches in a direction normal to any location along the trailing edge profile.

10. A turbine bucket according to claim 6 wherein the X and Y values set forth in Table I are scalable as a function of the same number to provide scaled-up or scaled-down trailing edge profiles.

11. A turbine bucket including a bucket airfoil having a tip shroud, said tip shroud having leading and trailing edges defining respective leading and trailing edge profiles substantially in accordance with values of X and Y in a Cartesian coordinate system at points 12–20 and 1–11, respectively, set forth in Table I, wherein the X and Y values are distances in inches which, when respective points 12–20 and 1–11 are connected by smooth, continuing arcs, define respective leading and trailing edge profiles of said tip shroud.

12. A turbine bucket according to claim 11 wherein the bucket airfoil has a profile at 95% span in accordance with the X, Y and Z coordinate values set forth in Table II wherein the Table II X, Y and Z coordinate values are in inches and have the same X, Y origin along a Z axis of the Cartesian coordinate system as the X, Y coordinate values.

13. A turbine bucket according to claim 12 wherein the X, Y and Z values of Table II are scalable as function of the same number to provide a scaled-up or scaled-down airfoil section.

14. A turbine bucket according to claim 11 wherein the respective leading edge and trailing edge profiles are consistent through the thickness of the tip shroud.

15. A turbine bucket according to claim 11 wherein the respective leading and trailing edge profiles lie in an envelope within ±0.080 inches in a direction normal to any location along the respective edge profiles.

16. A turbine bucket according to claim 11 wherein the X and Y values set forth in Table I are scalable as a function of the same number to provide scaled-up or scaled-down leading and trailing edge profiles, respectively.

* * * * *